US010676890B2

(12) United States Patent
McIntosh et al.

(10) Patent No.: US 10,676,890 B2
(45) Date of Patent: Jun. 9, 2020

(54) RETAINING WALL SYSTEM, METHOD OF SUPPORTING SAME, AND KIT FOR USE IN CONSTRUCTING SAME

(71) Applicants: Robert Gordon McIntosh, Abbotsford (CA); Brent Lester Paul Loates, Abbotsford (CA); Calum James Buchan, Abbotsford (CA)

(72) Inventors: Robert Gordon McIntosh, Abbotsford (CA); Brent Lester Paul Loates, Abbotsford (CA); Calum James Buchan, Abbotsford (CA)

( * ) Notice: Subject to any disclaimer, the term of this patent is extended or adjusted under 35 U.S.C. 154(b) by 0 days.

(21) Appl. No.: 15/858,915

(22) Filed: Dec. 29, 2017

(65) Prior Publication Data

US 2018/0119382 A1 May 3, 2018

Related U.S. Application Data

(63) Continuation of application No. 15/085,671, filed on Mar. 30, 2016, now Pat. No. 9,856,622.

(51) Int. Cl.
*E02D 29/02* (2006.01)
*E02D 7/00* (2006.01)
(Continued)

(52) U.S. Cl.
CPC ..... *E02D 29/02* (2013.01); *E02D 5/24* (2013.01); *E02D 5/34* (2013.01); *E02D 7/00* (2013.01);
(Continued)

(58) Field of Classification Search
CPC ... E02D 29/02; E02D 29/025; E02D 29/0216; E04G 23/04; E04B 2002/0223; E04B 2001/2439; E04B 2001/2463
See application file for complete search history.

(56) References Cited

U.S. PATENT DOCUMENTS 705,732 A 7/1902 Bone
837,962 A 12/1906 Rice
(Continued)

FOREIGN PATENT DOCUMENTS

AU 540765 B2 12/1984
CA 2075580 A1 2/1994
(Continued)

OTHER PUBLICATIONS

Chauhan et al., "Investigation of failure of a rigid retaining wall with relief shelves," Japanese Geotechnical Society Special Publication.

(Continued)

*Primary Examiner* — Tara Mayo-Pinnock
(74) *Attorney, Agent, or Firm* — Knobbe, Martens, Olson & Bear, LLP

(57) ABSTRACT

A retaining wall can include wall blocks positioned to retain material against a rear side of the wall blocks. A method for supporting such a retaining wall method includes attaching at least one of the wall blocks to at least one ground-stabilizing base body supporting the wall blocks. The ground-stabilizing base body can include a flexible cable attached to the rear side of at least one of the wall blocks and to a portion extending rearward away from the rear side of at least one of the wall blocks.

21 Claims, 11 Drawing Sheets

(51) Int. Cl.
*E02D 5/34* (2006.01)
*E02D 5/24* (2006.01)

(52) U.S. Cl.
CPC ..... *E02D 29/025* (2013.01); *E02D 29/0225* (2013.01); *E02D 2250/0023* (2013.01); *E02D 2250/0038* (2013.01); *E02D 2300/002* (2013.01); *E02D 2600/40* (2013.01)

(56) References Cited

U.S. PATENT DOCUMENTS

| | | | | |
|---|---|---|---|---|
| 1,356,319 | A | | 10/1920 | Smulski |
| 2,684,589 | A | | 7/1954 | Perreton |
| 3,195,312 | A | | 7/1965 | Rumsey, Jr. |
| 3,430,397 | A | | 3/1969 | Ellis |
| 3,613,382 | A | | 10/1971 | Dickinson |
| 3,951,384 | A | | 4/1976 | Hildreth, Jr. |
| 3,953,979 | A | | 5/1976 | Kurose |
| 4,473,978 | A | | 10/1984 | Wood |
| 4,512,685 | A | | 4/1985 | Hegle |
| 4,655,646 | A | | 4/1987 | Babcock et al. |
| 4,668,129 | A | | 5/1987 | Babcock et al. |
| 4,703,602 | A | | 11/1987 | Pardo |
| 4,824,293 | A | | 4/1989 | Brown et al. |
| 4,884,921 | A | | 12/1989 | Smith |
| 4,911,585 | A | | 3/1990 | Vidal et al. |
| 4,916,874 | A | | 4/1990 | McCoy et al. |
| 4,961,673 | A | | 10/1990 | Pagano et al. |
| 4,964,761 | A | | 10/1990 | Rossi |
| 4,982,544 | A | | 1/1991 | Smith |
| 5,028,172 | A | | 7/1991 | Wilson et al. |
| 5,030,035 | A | | 7/1991 | Babcock |
| 5,044,833 | A | | 9/1991 | Wilfiker |
| 5,066,169 | A | | 11/1991 | Gavin et al. |
| 5,131,791 | A | | 7/1992 | Kitziller |
| 5,154,542 | A | | 10/1992 | Klenert |
| 5,163,261 | A | | 11/1992 | O'Neill |
| 5,178,492 | A | | 1/1993 | Meheen |
| 5,178,493 | A | | 1/1993 | Vidal et al. |
| 5,224,801 | A | | 7/1993 | Quaney |
| 5,257,880 | A | | 11/1993 | Janopaul |
| 5,406,769 | A | | 4/1995 | Vidal et al. |
| 5,444,950 | A | | 8/1995 | Kelly et al. |
| 5,468,098 | A | * | 11/1995 | Babcock ..... E02D 29/0225 405/262 |
| 5,481,836 | A | * | 1/1996 | Miller ..... E04G 21/26 52/127.2 |
| 5,488,806 | A | | 2/1996 | Melnick et al. |
| 5,489,165 | A | | 2/1996 | Smith |
| 5,525,014 | A | | 6/1996 | Brown |
| 5,567,089 | A | | 10/1996 | Akamine |
| 5,611,181 | A | | 3/1997 | Shreiner et al. |
| 5,624,211 | A | | 4/1997 | Anderson et al. |
| 5,666,775 | A | | 9/1997 | Shreiner et al. |
| 5,697,736 | A | | 12/1997 | Veazey et al. |
| 5,795,106 | A | | 8/1998 | Herd |
| 5,799,456 | A | | 9/1998 | Shreiner et al. |
| 5,934,838 | A | | 8/1999 | Egan |
| 5,975,809 | A | | 11/1999 | Taylor et al. |
| 6,035,599 | A | | 3/2000 | Sonnentag |
| 6,113,316 | A | | 9/2000 | Ash |
| 6,213,689 | B1 | | 4/2001 | Hirai |
| 6,250,038 | B1 | | 6/2001 | Akamine |
| 6,430,884 | B1 | | 8/2002 | Shreiner et al. |
| 6,443,662 | B1 | | 9/2002 | Scales et al. |
| 6,447,213 | B1 | | 9/2002 | MacDonald |
| 6,675,547 | B1 | | 1/2004 | Golcheh |
| 6,705,057 | B2 | | 3/2004 | Smyer |
| 6,872,031 | B2 | | 3/2005 | May |
| 7,025,539 | B2 | | 4/2006 | Irvine |
| D555,810 | S | | 11/2007 | Strand |
| 7,360,970 | B2 | | 4/2008 | Woolford et al. |
| D579,122 | S | | 10/2008 | McIntosh |
| D587,381 | S | | 2/2009 | McIntosh |
| D600,359 | S | | 9/2009 | King |
| 7,584,584 | B2 | | 9/2009 | Fennell |
| 7,959,380 | B2 | | 6/2011 | McIntosh |
| 8,201,380 | B2 | | 6/2012 | Hargest et al. |
| 8,511,024 | B2 | | 8/2013 | MacDonald et al. |
| 8,938,836 | B2 | | 1/2015 | Chandra et al. |
| 2002/0001509 | A1 | | 1/2002 | Hong |
| 2003/0009970 | A1 | | 1/2003 | MacDonald et al. |
| 2003/0074856 | A1 | | 4/2003 | Hammer |
| 2003/0140840 | A1 | | 7/2003 | Yang |
| 2004/0134154 | A1 | | 7/2004 | Bott |
| 2004/0159065 | A1 | | 8/2004 | Burgess et al. |
| 2004/0161307 | A1 | | 8/2004 | Hammer |
| 2005/0008438 | A1 | | 1/2005 | Babcock |
| 2005/0091940 | A1 | | 5/2005 | Whitson |
| 2006/0188344 | A1 | | 8/2006 | Boys |
| 2008/0095585 | A1 | | 4/2008 | La |
| 2008/0120931 | A1 | | 5/2008 | Joslyn |
| 2008/0313989 | A1 | | 12/2008 | Ireland |
| 2009/0094917 | A1 | | 4/2009 | McItosh |
| 2009/0116911 | A1 | | 5/2009 | Shaw |
| 2009/0238648 | A1 | | 9/2009 | Wilkman |
| 2011/0217127 | A1 | | 9/2011 | MacDonald |
| 2014/0083033 | A1 | | 3/2014 | McIntosh et al. |
| 2014/0270990 | A1 | | 9/2014 | Heraty |
| 2015/0040507 | A1 | | 2/2015 | MacDonald et al. |
| 2016/0160468 | A1 | | 6/2016 | Rossi |
| 2016/0024742 | A1 | | 10/2016 | Heister |
| 2017/0284052 | A1 | | 10/2017 | McIntosh et al. |
| 2019/0100894 | A1 | | 4/2019 | Nicol et al. |

FOREIGN PATENT DOCUMENTS

| | | | |
|---|---|---|---|
| CA | 2290327 | A1 | 5/2001 |
| CA | 2592213 | | 5/2011 |
| CA | 3000082 | A1 | 6/2018 |
| CN | 86207001 | U | 11/1987 |
| CN | 1270261 | A | 10/2000 |
| CN | 1605679 | | 4/2005 |
| CN | 200971506 | Y | 11/2007 |
| CN | 101381994 | | 3/2009 |
| CN | 201649123 | U | 11/2010 |
| CN | 102587410 | A | 7/2012 |
| CN | 102926400 | | 2/2013 |
| CN | 103452132 | A | 12/2013 |
| CN | 104631491 | A | 5/2015 |
| CN | 104805850 | A | 7/2015 |
| CN | 104818724 | A | 8/2015 |
| CN | 105951875 | A | 9/2016 |
| EP | 0 021 449 | A1 | 1/1981 |
| EP | 0 190 076 | A1 | 8/1986 |
| EP | 2549022 | | 1/2013 |
| FR | 2 651 258 | A1 | 3/1991 |
| GB | 1477221 | | 6/1977 |
| JP | S58-120924 | | 7/1983 |
| JP | S60-43531 | | 3/1985 |
| JP | H6-73744 | A | 3/1994 |
| JP | H7-145625 | | 6/1995 |
| JP | H9-158223 | | 6/1997 |
| JP | H9-170240 | | 6/1997 |
| JP | H10-152848 | | 6/1998 |
| JP | H10-195894 | | 7/1998 |
| JP | 2000-080664 | A | 3/2000 |
| JP | 2000-204571 | | 7/2000 |
| JP | 2000-314143 | | 11/2000 |
| JP | 2002-322656 | | 11/2002 |
| JP | 2006-316462 | | 11/2006 |
| JP | 2008-163660 | A | 7/2008 |
| JP | 2010-242473 | A | 10/2010 |
| JP | 2010-242474 | A | 10/2010 |
| KR | 10-0710850 | B1 | 4/2007 |
| KR | 10-0824713 | B1 | 4/2008 |
| KR | 10-2008-0077721 | | 8/2008 |
| KR | 2009-0100160 | A | 9/2009 |
| KR | 20090096238 | | 9/2009 |
| KR | 2010-0115919 | A | 10/2010 |
| KR | 10-1006963 | | 1/2011 |
| KR | 2011-0027199 | A | 3/2011 |
| KR | 10-2012-0030513 | | 3/2012 |
| KR | 2012-0021686 | A | 3/2012 |

(56) References Cited

FOREIGN PATENT DOCUMENTS

| | | | |
|---|---|---|---|
| KR | 10-1138915 | B1 | 5/2012 |
| KR | 2015-0135659 | A | 12/2015 |
| KR | 2016-0150411 | A | 12/2016 |
| KR | 2017-0038769 | A | 4/2017 |
| UA | 63578 | A | 1/2004 |
| WO | WO 2007/046142 | A1 | 4/2007 |
| WO | WO 2015/007796 | A2 | 1/2015 |

OTHER PUBLICATIONS

Chougule et al., "Effective Use of Shelves in Cantilever Retaining Walls," IRJET, vol. 04 Issue: 07, Jul. 2017.
"Counterfort Retaining Wall"—Bing images, retrieved from the internet on Sep. 27, 2017.
Erizal, "Design and Detailing of Retaining Walls," PowerPoint, Departemen Teknik Sipil Dan Lingkungan Fakultas Teknologi Pertanian IPB; SIL211 MEKANIKA TANAH, 3(2-3).
Gowda et al., "Stability Enhancement of Cantilever Earth Retaining Wall with Pressure Relief Shelf by Soft Computing Technique" Advanced Engineering and Applied Sciences: An International Journal 2016; 6(2): 65-68.
"High Tensile Coil Rod," Data Sheet—High Tensile Coil Rod, Spectrum Concrete Products.
Kaizer et al., "Counterfort Retaining Wall" Gandhinagar Institute of Technology: Department of Civil Engineering.
Padhye et al., "Analysis of Retaining Wall with Pressure Relief Shelf by Coulomb's Method" Proceedings of Indian Geotechnical Conference, Dec. 15-17, 2011, Kochi (Paper No. K-106).
Shehata, "Retaining walls with relief shelves" Innov. Infrastruct. Solut. (2016) 1:4.
Shinde et al., "Optimum Static Analysis of Retaining Wall with & without shelf /Shelve at different level using finite Element analysis," International Journal of Engineering Research and General Science vol. 3, Issue 2, Part 2, Mar.-Apr. 2015.
"TechWall"—Reinforced Earth, Sustainable Technology.
Tonne et al., "Optimization and Improvement in Stability of Counterfort Retaining Wall With Relief Shelf," IJRET: vol. 04 Issue: 04; Apr. 2015.
"Type T—Spherical Head T Anchors" (info-sheet) Construction Fixing Systems.
Watve et al., "Static Analysis of Retaining Wall With & Without Shelf by Using F.E.M Simulation," Global Journal of Engineering Science and Research Management; 2(7): Jul. 2015.

* cited by examiner

RETAINING WALL SYSTEM, METHOD OF SUPPORTING SAME, AND KIT FOR USE IN CONSTRUCTING SAME

RELATED APPLICATIONS

The present application is a continuation of U.S. application Ser. No. 15/085,671, filed Mar. 30, 2016. The complete disclosure of this prior application is hereby incorporated by reference herein.

FIELD

This disclosure relates generally to retaining walls.

RELATED ART

A retaining wall may retain material such as earth against a rear side of the retaining wall, but retaining walls may fail if not adequately supported. Failure of a retaining wall can involve lateral pushout, in which one or more individual blocks, or the entire retaining wall, moves too far forward in response to forces exerted by material against the rear side. Failure of a retaining wall can also involve overturning, in which the retaining wall loses any initial batter and moves too far forward (for example over a vertical axis) in response to forces exerted by material against the rear side. Failure of a retaining wall can also involve global failure, in which material behind and below the retaining wall becomes unstable and the retaining wall moves, along with the material behind and below the retaining wall, into a position that is no longer stable.

Some retaining walls may resist destabilizing forces by building the walls with a batter or by using reinforced earth, for example with geogrid. However, supporting a retaining wall with geogrid or other reinforced earth can require excavating a very large volume of material (such as native earth, for example) from a large backfill region behind where the retaining wall, and then constructing reinforced earth (with geogrid, for example) in the excavated region. Such excavation can be very costly, particularly if utilities, buildings, trees, or other objects complicate the excavation. Further, property lines, steep hills, and legal or other restrictions may complicate or prevent excavation. Still further, the excavated material (native earth, for example) may not be suitable for constructing reinforced earth, so supporting a retaining wall with geogrid or other reinforced earth can require discarding large volumes of excavated material and also acquiring large volumes of a replacement material for constructing the reinforced earth, which can also be very costly.

SUMMARY

In one embodiment, there is disclosed a method of supporting a retaining wall comprising a plurality of wall blocks positioned to retain material against a rear side of the plurality of wall blocks, the method comprising attaching at least one of the plurality of wall blocks, on the rear side of the at least one of the plurality of wall blocks, to at least one ground-stabilizing base body supporting the plurality of wall blocks.

In some embodiments, attaching the at least one of the plurality of wall blocks to the at least one ground-stabilizing base body comprises applying tension to at least one flexible cable attached to the rear side of the at least one of the plurality of wall blocks and to the at least one ground-stabilizing base body.

In some embodiments, applying tension to the at least one flexible cable comprises applying tension to a flexible cable attached to the rear side of one of the plurality of wall blocks and to a portion of the at least one ground-stabilizing base body extending rearward from the rear side of the at least one of the plurality of wall blocks with the flexible cable extending rearward away from the rear side of the at least one of the plurality of wall blocks.

In some embodiments, applying tension to the at least one flexible cable comprises applying tension to a flexible cable attached to: the rear side of at least one of wall blocks in a first stack of the plurality of wall blocks; the rear side of at least one of wall blocks in a second stack of the plurality of wall blocks adjacent the first stack; and the at least one ground-stabilizing base body supporting the wall blocks in the first and second stacks.

In some embodiments: the at least one of the wall blocks in the first stack and the at least one of the wall blocks in the second stack are in alternating rows of the first and second stacks; and the flexible cable extends diagonally from the rear side of the at least one of the wall blocks in the first stack to the rear side of the at least one of the wall blocks in the second stack.

In some embodiments, applying tension to the flexible cable comprises: sliding the flexible cable against a first attachment surface on the rear side of the at least one wall block in the first stack; and sliding the flexible cable against a second attachment surface on the rear side of the at least one wall block in the second stack.

In some embodiments, the flexible cable is attached to a pile attached to the portion of the at least one ground-stabilizing base body and engaging material under the at least one ground-stabilizing base body.

In some embodiments, the method further comprises attaching at least one pile to the at least one ground-stabilizing base body.

In some embodiments, the method further comprises engaging the at least one pile with material under the at least one ground-stabilizing base body.

In some embodiments, engaging the at least one pile with the material under the at least one ground-stabilizing base body comprises positioning concrete in at least one respective space between the at least one pile and the material under the at least one ground-stabilizing base body.

In some embodiments, the method further comprises, when the at least one ground-stabilizing base body is already formed and before supporting the plurality of wall blocks on the at least one ground-stabilizing base body, positioning the at least one ground-stabilizing base body into a position on a surface for supporting the plurality of wall blocks.

In another embodiment, there is disclosed a kit for use in constructing a retaining wall, the kit comprising: a plurality of wall blocks configured to be positioned into at least one stack with material retained against a rear side of the plurality of wall blocks; and at least one base body positionable on a surface, configured to stabilize ground under the surface, and configured to support the at least one stack of the plurality of wall blocks; wherein the plurality of wall blocks are configured to be attached, on the rear side of the at least one of the plurality of wall blocks, to the at least one base body when the at least one base body supports the plurality of wall blocks.

In some embodiments, the kit further comprises at least one pile separate from the at least one base body, attachable to the at least one base body, and configured to engage with material under the at least one base body when the at least one pile is attached to the at least one base body and when the at least one base body supports the plurality of wall blocks.

In another embodiment, there is disclosed a retaining wall system comprising: a plurality of wall blocks retaining material on a rear side of the plurality of wall blocks; and at least one ground-stabilizing base body supporting the plurality of wall blocks; wherein at least one of the plurality of wall blocks is attached, on the rear side of the at least one of the plurality of wall blocks, to the at least one ground-stabilizing base body.

In some embodiments, the system further comprises at least one flexible cable attaching the rear side of the at least one of the plurality of wall blocks and the at least one ground-stabilizing base body.

In some embodiments: the at least one ground-stabilizing base body comprises a portion extending rearward from the rear side of the at least one of the plurality of wall blocks; the at least one flexible cable comprises a flexible cable attached to rear side of one of the plurality of wall blocks and to the portion of the at least one ground-stabilizing base body extending rearward from the rear side of the at least one of the plurality of wall blocks; and the flexible cable extends rearward away from the rear side of the at least one of the plurality of wall blocks.

In some embodiments: the plurality of wall blocks comprises wall blocks in a first stack and wall blocks in a second stack adjacent the first stack; the at least one ground-stabilizing base body comprises a first ground-stabilizing base body supporting the first stack and a second ground-stabilizing base body supporting the second stack; and the at least one flexible cable comprises a flexible cable attaching the rear side of at least one of the wall blocks in the first stack, the rear side of at least one of the wall blocks in the second stack, and one of the first and second ground-stabilizing base bodies.

In some embodiments: the at least one of the wall blocks in the first stack and the at least one of the wall blocks in the second stack are in alternating rows of the first and second stacks; and the flexible cable extends diagonally from the rear side of the at least one of the wall blocks in the first stack to the rear side of the at least one of the wall blocks in the second stack.

In some embodiments: the flexible cable is slidably attached to the at least one wall block in the first stack at a first attachment surface of the at least one wall block in the first stack; and the flexible cable is slidably attached to the at least one wall block in the second stack at a second attachment surface of the at least one wall block in the second stack.

In some embodiments, the flexible cable is attached to a pile attached to the portion of the at least one ground-stabilizing base body and engaging material under the at least one ground-stabilizing base body.

In some embodiments, the system further comprises at least one pile attached to the at least one ground-stabilizing base body and engaging material under the at least one ground-stabilizing base body.

In some embodiments, the system further comprises concrete in a respective space between the at least one pile and the material under the at least one ground-stabilizing base body.

In some embodiments, the at least one ground-stabilizing base body supports the plurality of wall blocks independently of any structure in the material retained against the rear side of the plurality of wall blocks.

In some embodiments, the plurality of wall blocks collectively extend at least 12 feet above the at least one ground-stabilizing base body.

In some embodiments, the plurality of wall blocks collectively extend at least 15 feet above the at least one ground-stabilizing base body.

In some embodiments, the plurality of wall blocks collectively extend at least 20 feet above the at least one ground-stabilizing base body.

In some embodiments: the plurality of wall blocks define at least one drainage channel configured to direct liquid from the rear side of the plurality of wall blocks to the at least one ground-stabilizing base body; and the at least one ground-stabilizing base body defines at least one drainage channel configured to direct liquid, from the at least one drainage channel of the plurality of wall blocks, out of the system.

Other aspects and features will become apparent to those ordinarily skilled in the art upon review of the following description of illustrative embodiments in conjunction with the accompanying figures.

DETAILED DESCRIPTION

Figure 1:
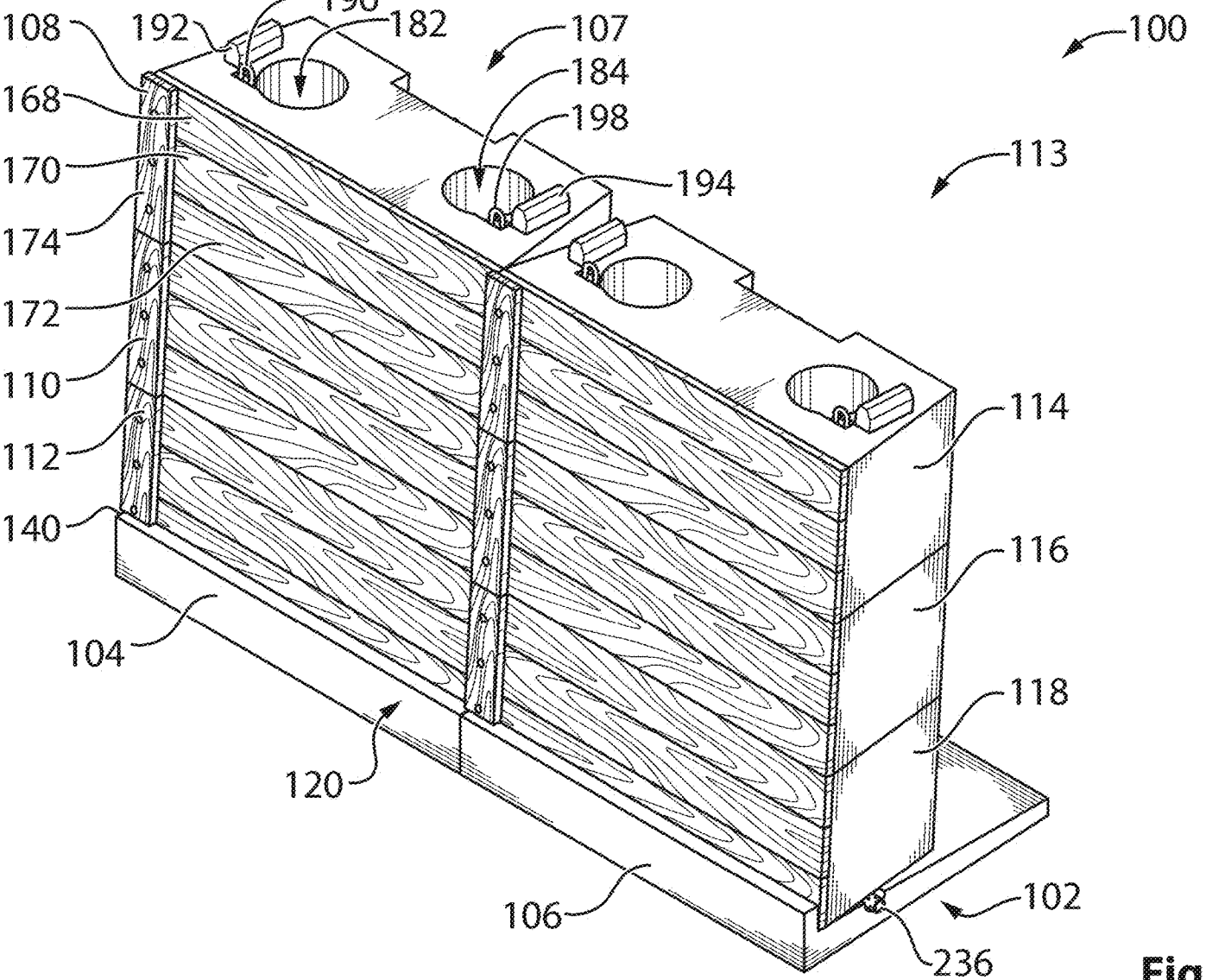
FIG. 1 is a top front perspective view of a retaining wall system according to one embodiment.

Referring to FIG. 1, a modular-block retaining wall system according to one embodiment is shown generally at 100. The system 100 includes a base shown generally at 102 and including base bodies 104 and 106. The system 100 also includes a stack shown generally at 107 of wall blocks 108, 110, and 112 supported by the base body 104, and a stack shown generally at 113 of wall blocks 114, 116, and 118 adjacent the stack 107 and supported by the base body 106.

Figure 2:
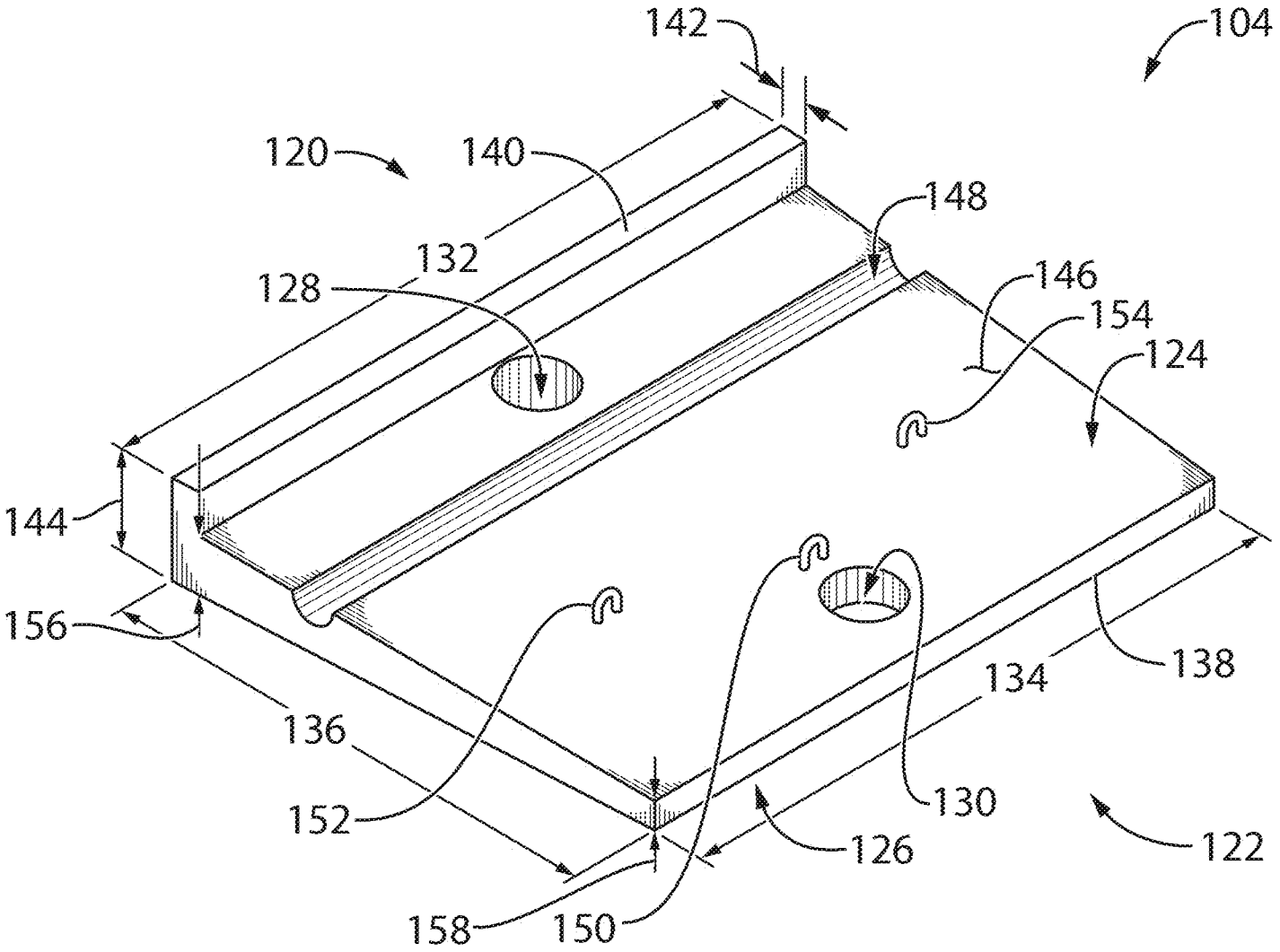
FIG. 2 is a top rear perspective view of a base body of the system of FIG. 1.

Referring to FIG. 2, the base body 104 is a rebar-reinforced concrete body cast from concrete (such as standard highway-grade concrete having a compressive strength of about 4,000 pounds per square inch or about 27.6 megapascals, for example) to have the appearance shown in FIG. 2 and described below. In general, materials and configurations disclosed herein are only examples of some embodiments, and are not intended to limit or narrow the scope of this disclosure. Alternative embodiments may include different materials and configurations.

The base body 104 has a front side shown generally at 120, a rear side shown generally at 122, a top side shown generally at 124, and a bottom side shown generally at 126. Through-openings shown generally at 128 and 130 extend between the top side 124 and the bottom side 126 and have diameters of about 10 inches (or about 25 centimeters) to about 12 inches (or about 30 centimeters). In general, dimensions disclosed herein are only examples of some embodiments, and are not intended to limit or narrow the scope of this disclosure. Alternative embodiments may include different dimensions.

On the front side 120, the base body 104 has a width 132 of about 95.25 inches (or about 242 centimeters), and on the rear side 122, the base body 104 has a width 134 of about 88 inches (or about 223.5 centimeters). Between the front side 120 and the rear side 122, the base body 104 has a horizontal depth 136 of about 6 feet (or about 183 centimeters). A bottom surface 138 on the bottom side 126 of the base body 104 is generally planar. In this context, "generally planar" refers to a structure that may not be perfectly planar, but that may function the same as or substantially similar to a planar structure. More generally, "generally" herein includes variations to an aspect, embodiment, or component that may function the same as or substantially similar to such an aspect, embodiment, or component.

Also on the front side 120, a retaining projection 140 has a thickness 142 of about 4 inches (or about 10 centimeters) and projects to a height 144 of about 14 inches (or about 35.6 centimeters) from the bottom surface 138. On the top side 124, the base body 104 has a support surface 146 extending from the retaining projection 140 to the rear side 122. The support surface 146 is generally planar, except that a generally semi-cylindrical recess shown generally at 148 extends laterally across the base body 104 and has a diameter of about 6 inches (or about 15 centimeters). A center of the generally semi-cylindrical recess 148 is about 21 inches (or about 53.3 centimeters) from a front edge of the base body 104.

A central attachment loop 150 and lateral attachment loops 152 and 154 are formed from galvanized or stainless steel cables having a diameter of about 0.625 inches (or about 1.6 centimeters) with breaking strengths of about 46,000 pounds (or about 205,000 newtons) or about 50,000 pounds (or about 222,500 newtons) or more, and are embedded in, and attached to, the base body 104. The cables in other embodiments may vary, for example for higher loads that may be required in other embodiments. Further, cables described herein may be aircraft cables or other cables. The central attachment loop 150 is approximately centered laterally on the base body 104 and about 20 inches (or about 51 centimeters) from a rear edge of the base body 104. The lateral attachment loops 152 and 154 are about 6 feet (or about 183 centimeters) from the front edge of the base body 104 and spaced apart from each other by about 4 feet (or about 122 centimeters).

The base body 104 is tapered so that, adjacent the retaining projection 140, the base body 104 has a height 156 of about 8 inches (or about 20.3 centimeters), and at the rear edge, the base body 104 has a height 158 of about 4 inches (or about 10 centimeters) in the embodiment shown. As a result, the stack 107 in the embodiment shown in FIG. 1 has a batter of about 3.4 degrees when supported by the base body 104. The base body 106 is substantially the same as the base body 104. However, base bodies according to other embodiments may vary, for example with different materials, dimensions, or configurations. For example, in other embodiments, the height 158 is about 5 inches to about 6 inches (or about 12.7 centimeters to about 15.2 centimeters).

Figure 3:
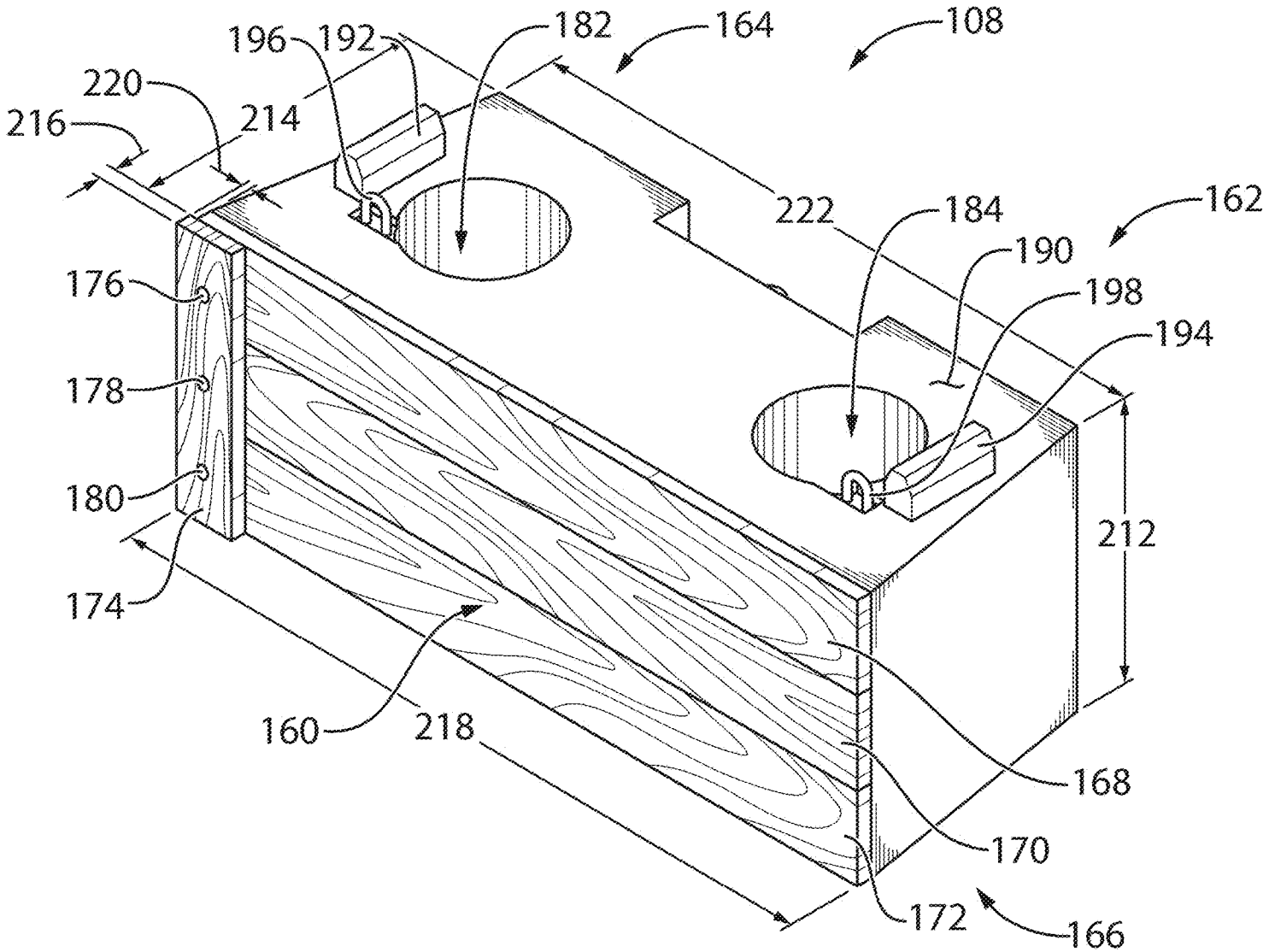
FIG. 3 is a top front perspective view of a wall block of the system of FIG. 1.
Figure 4:
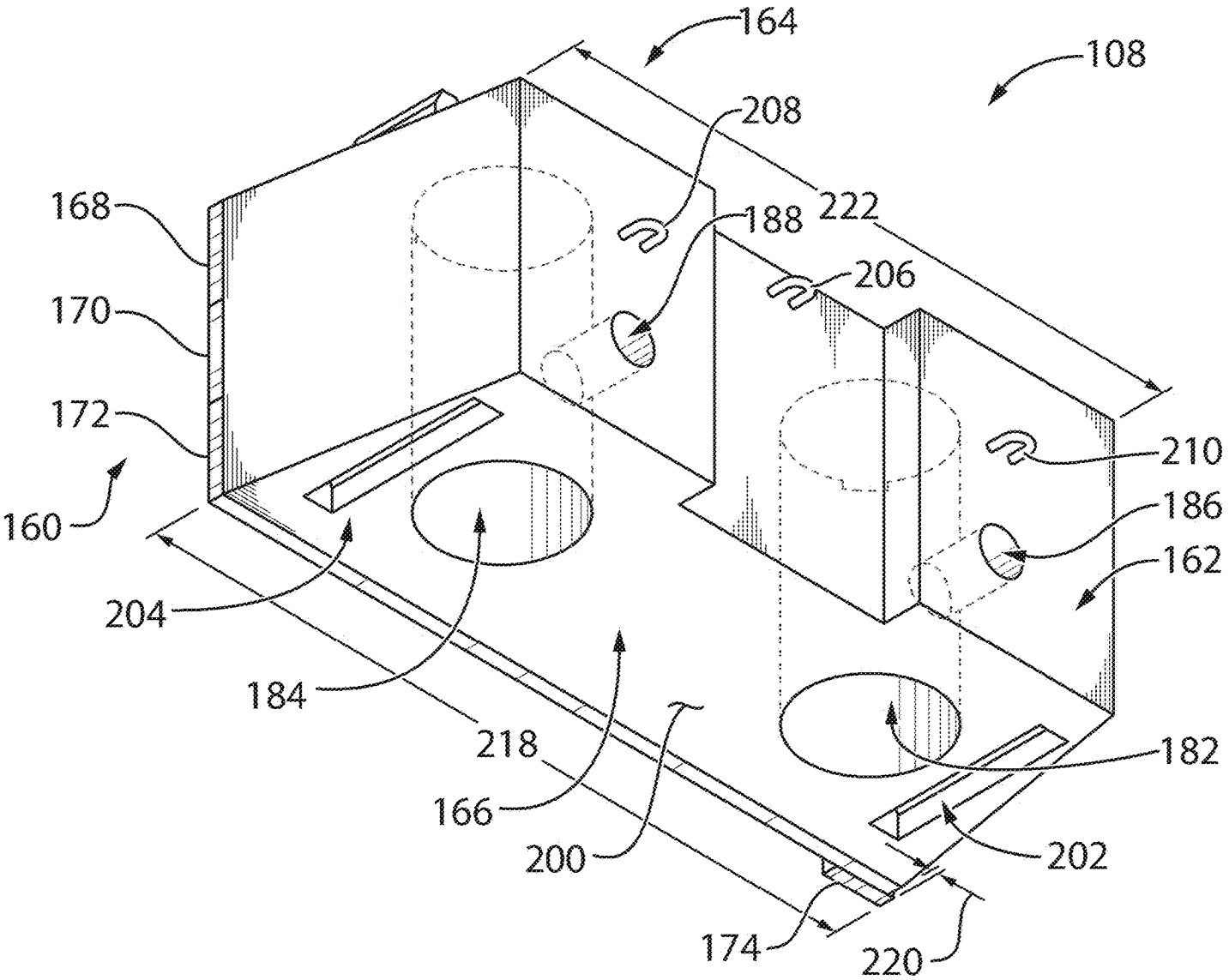
FIG. 4 is a bottom rear perspective view of the wall block of FIG. 3.

Referring to FIGS. 3 and 4, the wall block 108 is cast from concrete (such as standard highway-grade concrete having a compressive strength of about 4,000 pounds per square inch or about 27.6 megapascals, for example) to have the appearance shown in FIGS. 3 and 4 and described below. The wall block 108 has a front side shown generally at 160, a rear side shown generally at 162, a top side shown generally at 164, and a bottom side shown generally at 166.

On the front side 160, the wall block 108 has surfaces having images depicting generally horizontal wood boards 168, 170, and 172, an image depicting a generally vertical board 174, and images depicting bolts 176, 178, and 180 fastening the wood board 174 to the wood boards 168, 170, and 174 respectively. The images depicting the wood boards 168, 170, 172, 174, and the images depicting the bolts 176, 178, and 180, may be created using a process similar to the processes illustrated in FIGS. 20-22 of U.S. Pat. No. 7,959,380. The entire contents of U.S. Pat. No. 7,959,380 are incorporated by reference herein. As described in the description of FIGS. 20-22 of U.S. Pat. No. 7,959,380, one or more image templates or form liners may be formed (from urethane, for example) to have image-forming surfaces formed from, and complementary to, wood boards defining the images depicting the wood boards 168, 170, 172, and 174 and bolts defining the images depicting the bolts 176, 178, and 180. The image templates or form liners may be placed in a mold, and a colored slurry (for example including iron oxide pigments mixed with water and cement in a volume ratio of about 12.5% iron oxide pigment, about 37.5% water, and about 50% cement) may be mixed very well (for example with a power mixing tool such as a hand mixer) and applied (with a paint brush, for example) on the image-forming surfaces to impart a color (such as a brown wood color, for example) to concrete near the image-forming surfaces. Concrete in such a mold may be cast to form the wall block 108.

The wall block 108 defines generally cylindrical drainage channels shown generally at 182 and 184 and extending between the top side 164 and the bottom side 166 of the wall block 108, each having a diameter of about 18 inches (or about 46 centimeters) or about 21 inches (or about 53 centimeters). A generally cylindrical drainage inlet shown generally at 186 extends between the rear side 162 and the generally cylindrical drainage channel 182, and a generally cylindrical drainage inlet shown generally at 188 extends between the rear side 162 and the drainage channel 184. The generally cylindrical drainage inlets 186 and 188 have diameters of about 6 inches (or about 15 centimeters) and are tapered downwards by about 2 degrees to facilitate flow of water from the rear side 162, through the generally cylindrical drainage inlets 186 and 188, and into the generally cylindrical drainage channels 182 and 184.

On the top side, the wall block 108 has a top surface 190 and alignment projections 192 and 194 projecting upward from the top surface 190. Also on the top side 164, the wall block 108 includes top attachment loops 196 and 198 formed from galvanized or stainless steel cables having a diameter of about 0.625 inches (or about 1.6 centimeters) with breaking strengths of about 46,000 pounds (or about 205,000 newtons) or about 50,000 pounds (or about 222,500 newtons) or more, and embedded in, and attached to, the wall block 108 for use in lifting and moving the wall block 108. The cables in other embodiments may vary, for example for higher loads that may be required in other embodiments.

On the bottom side 166, the wall block 108 has a bottom surface 200 and alignment recesses shown generally at 202 and 204. The alignment recesses 202 and 204 are complementary to the alignment projections 192 and 194 respectively, so that when the bottom surface 200 of the wall block 108 is positioned on top of a top surface (corresponding to the top surface 190) of an adjacent wall block (such as the wall block 110 shown in FIG. 1), then the alignment recesses 202 and 204 receive the alignment projections (corresponding to the alignment projections 192 and 194 respectively) of the adjacent wall block to align the wall block 108 to the adjacent wall block. The wall block 108 is thus stackable into a stack, such as the stack 107 shown in FIG. 1. Further, the alignment projections 192 and 194 and the alignment recesses 202 and 204 facilitate coupling wall blocks such as the wall block 108 in a stack, so that the wall blocks in the stack have a tendency to remain in the stack, and so that attaching one or more of the wall blocks in the stack to a base body (as described below) may hold the entire stack in place.

When wall blocks such as the wall block 108 are stacked into a stack, the generally cylindrical drainage channels (such as the generally cylindrical drainage channels 182 and 184) of the wall blocks in the stack are adjacent corresponding generally cylindrical drainage channels of the adjacent wall blocks in the stack such that the generally cylindrical drainage channels form continuous drainage channels in the stack and throughout the entire height of the stack.

On the rear side 162, the wall block 108 includes a central rear attachment loop 206 and lateral rear attachment loops 208 and 210 formed from galvanized or stainless steel cables having a diameter of about 0.625 inches (or about 1.6 centimeters) with breaking strengths of about 46,000 pounds (or about 205,000 newtons) or about 50,000 pounds (or about 222,500 newtons) or more, and embedded in, and attached to, the wall block 108. The cables in other embodiments may vary, for example for higher loads that may be required in other embodiments. The central rear attachment loop 206 is centered laterally on the rear side 162 of the wall block 108, and the lateral rear attachment loops 208 and 210 are on opposite lateral sides of the rear side 162 of the wall block 108.

Overall, the wall block 108 has a height 212 between the top surface 190 and the bottom surface 200 of about 35.375 inches (or about 89.9 centimeters) and a horizontal depth 214 between the front surfaces of the images depicting the generally horizontal wood boards 168, 170, and 172 and the rear side 162 also of about 35.375 inches (or about 89.9 centimeters). An additional portion on the front side 160, and having the image depicting the generally vertical wood board 174 and the images depicting the bolts 176, 178, and 180, has a further horizontal depth 216 of about 2 inches (or about 5 centimeters). On the front side 160, the wall block 108 has a width 218 of about 96.25 inches (or about 244.5 centimeters), including a horizontal overhang 220 of about 1 inch (or about 2.5 centimeters). On the rear side 162, the wall block 108 has a width 222 of about 83.25 inches (or about 211.5 centimeters). The wall blocks 110, 112, 114, 116, and 118 are substantially the same as the wall block 108. However, wall blocks according to other embodiments may vary, for example with different materials, dimensions, or configurations.

Figure 5:
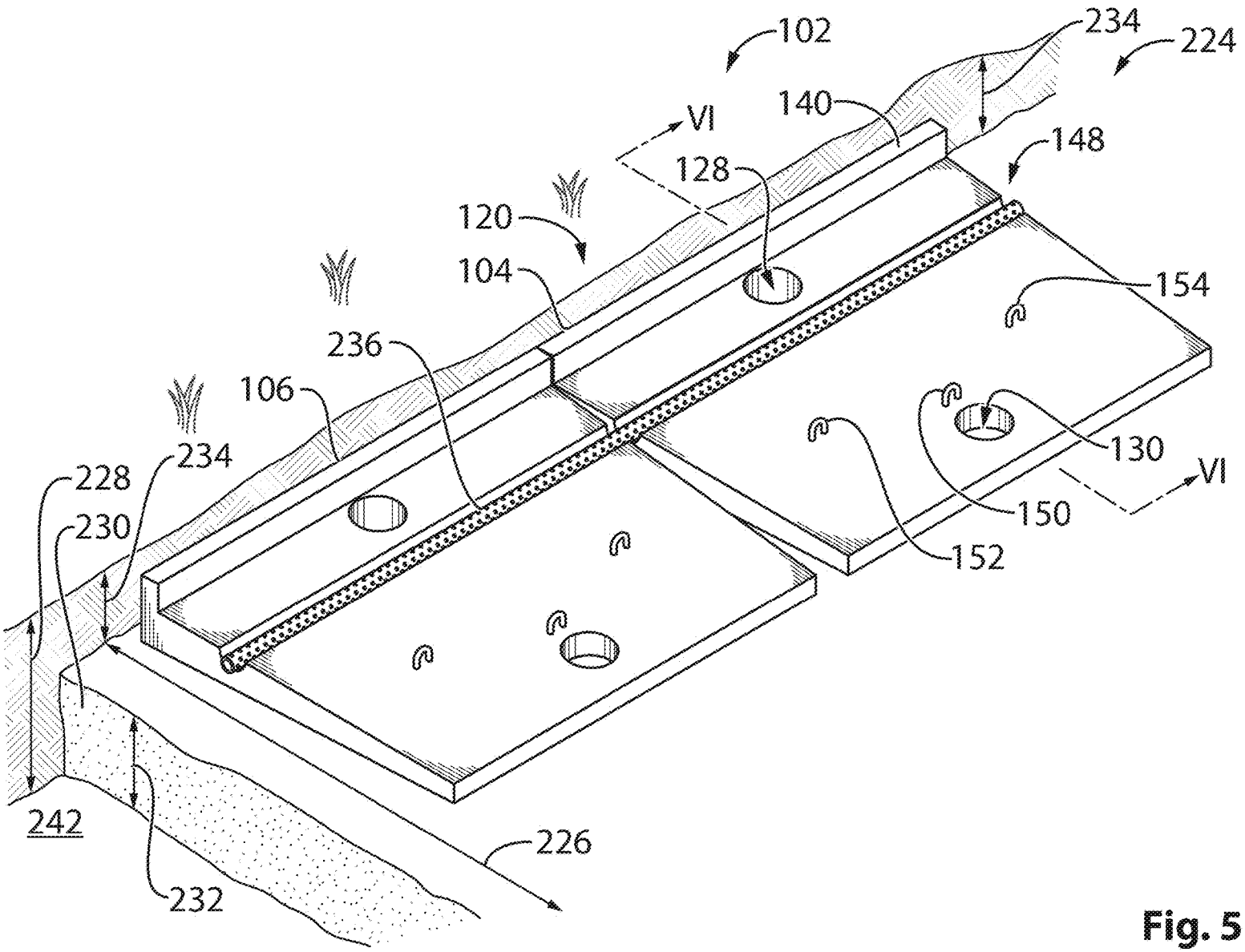
FIG. 5 illustrates a base of the system of FIG. 1 during a method according to one embodiment of constructing the system of FIG. 1.

FIGS. 1 and 5-10 illustrate a method of constructing the system 100. Referring to FIG. 5, the method involves excavating a trench shown generally at 224 and having a horizontal width 226 of about 10 feet (or about 3 meters) and a vertical depth 228 of about 20 inches (or about 50 centimeters). The trench may be along a generally straight line, or curved either partially or entirely. Further, the material to be retained by the system 100 may be temporarily excavated (for example at a slope determined according to the material to be retained by the system 100) to provide room for construction of the system 100 as described below.

Then, at least a portion of the trench 224 may be filled with sand or gravel 230 (such as "three-quarter-inch minus" or "nineteen-millimeter minus" crushed sand and gravel, or 0.75-inch or 19-millimeter clear crushed gravel, for example) compacted to 100% standard proctor density ("SP-MDD") and to a thickness 232 of about 6 inches (or about 15 centimeters) and leveled. A height 234 above the compacted sand or gravel 230 is thus about the height 144 (shown in FIG. 2) of the retaining projection 140 over the bottom surface 138 of the base body 104.

Base bodies (such as the base bodies 104 and 106) may then be positioned laterally adjacent each other with their bottom surfaces (such as the bottom surface 138 of the base body 104) on the compacted sand or gravel 230 after the base bodies are already formed. The base bodies are thus pre-cast. The bottom surfaces are relatively large, which distributes weight of wall blocks over relatively large areas and may prevent or reduce settling. Front sides (such as the front side 120 of the base body 104) face away from material to be retained by the system 100, such as soil or other earth behind the base 102 (on rear sides of the base bodies such as the rear side 122 of the base body 104) and behind the trench 224. The base bodies may be positioned generally linearly so that their front surfaces are collinear, or the base bodies may be positioned along one or more curves.

A perforated pipe 236, made of polyvinyl chloride ("PVC") and having a diameter of about 2.875 inches or about 3 inches (or about 73 millimeters or about 75 millimeters), may be positioned laterally across the base bodies 104 and 106 and received in the generally semi-cylindrical recesses (such as the generally semi-cylindrical recess 148) of the base bodies.

Figure 6:
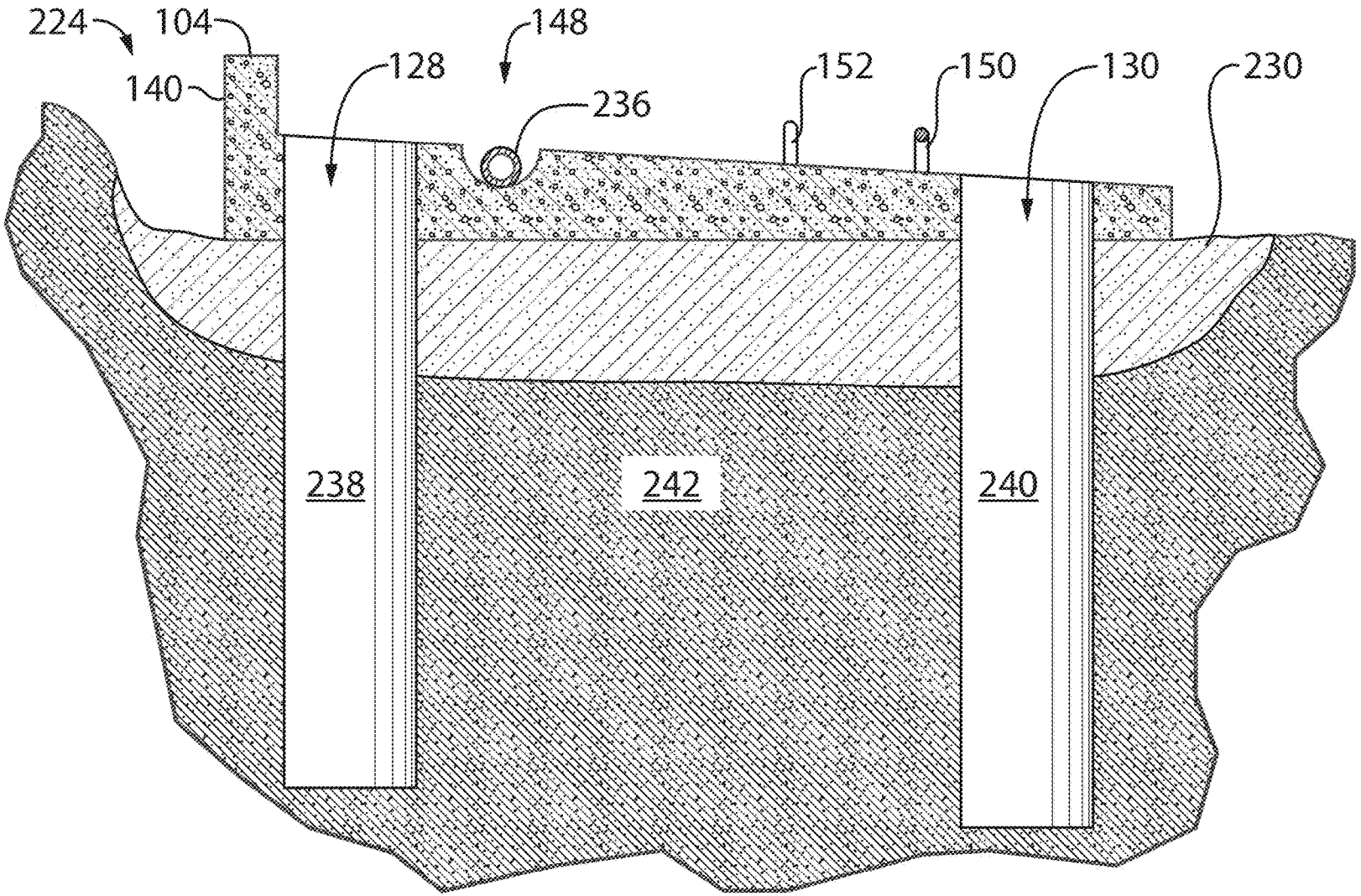
FIG. 6 is a cross-sectional view of the base of FIG. 5 taken along the line VI-VI in FIG. 5.

Referring to FIG. 6, once the base bodies 104 and 106 are positioned as shown in FIG. 5, a hole 238 may be created under the through-opening 128 in the compacted sand or gravel 230 and in pre-existing soil, earth, or other material 242 under the base body 104, and a hole 240 may be created under the through-opening 130 in the compacted sand or gravel 230 and in the pre-existing soil, earth, or other material 242 under the base body 104. The holes 238 and 240 have diameters of about 10 inches (or about 25 centimeters) to about 12 inches (or about 30 centimeters) for example to match the diameters of the through-openings 128 and 130 respectively. In general, holes below the through-openings (such as the through-openings 128 and 130) may be created using a post-hole-style auger (for sand, silt, or clay, for example) or vacuum excavation (for gravel or for gravelly soil, for example).

Figure 7:
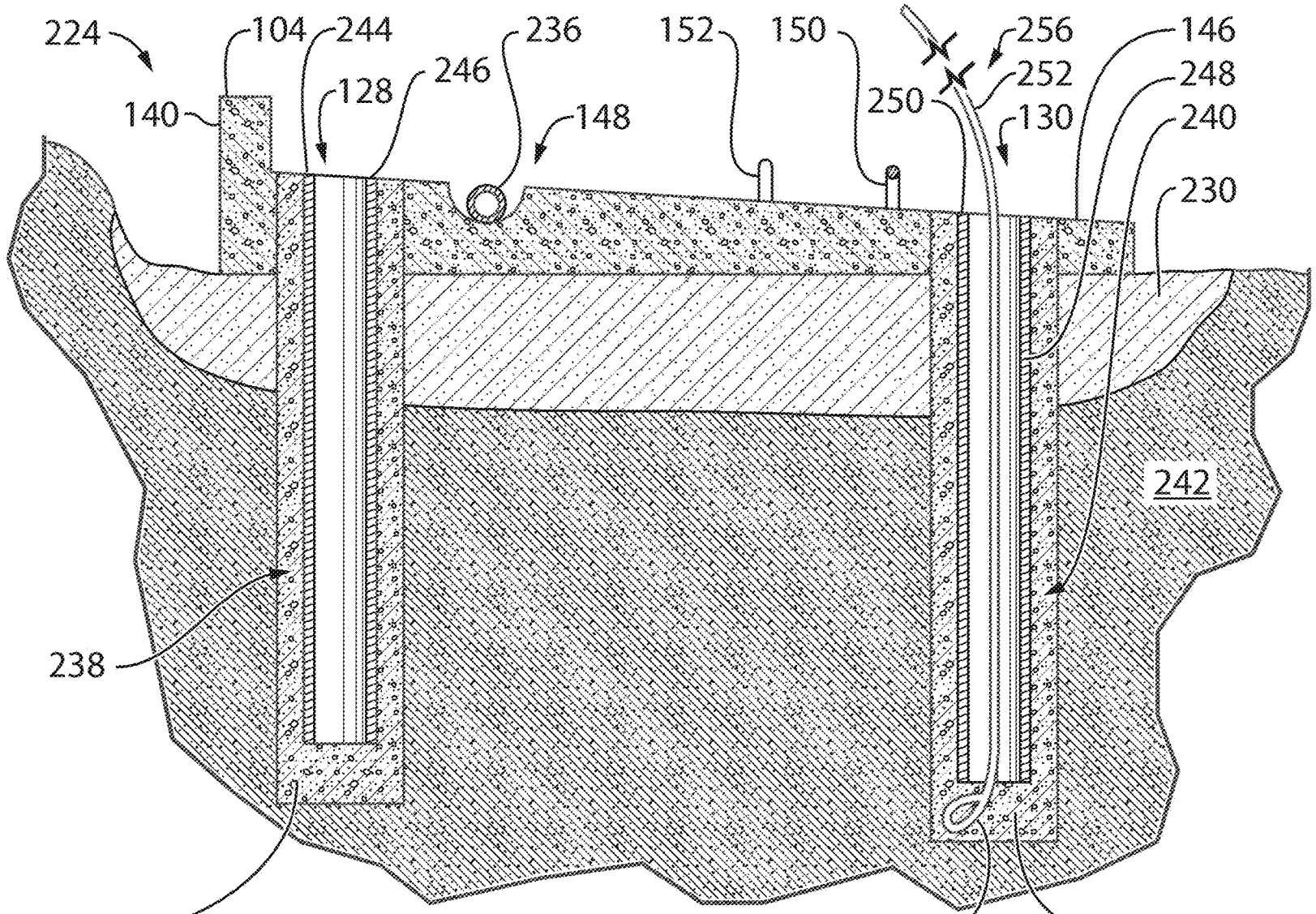
FIG. 7 is the cross-sectional view of FIG. 6, further illustrating the method according to one embodiment of constructing the system of FIG. 1.

Referring to FIG. 7, a pile 244 may be positioned in the hole 238 with an upper edge 246 of the pile 244 generally coplanar with the support surface 146 of the base body 104, and a pile 248 may be positioned in the hole 240 with an upper edge 250 of the pile 248 generally coplanar with the support surface 146. The diameters, lengths, and other properties of the piles in various embodiments may vary depending on soil conditions, the overall height of the retaining wall of the system 100, and other factors. In some embodiments, the piles 244 and 248 are steel pipes that may have diameters between about 4 inches and about 10 inches (or between about 10 centimeters and about 25 centimeters), or about 6 inches (or about 15 centimeters) or about 8 inches (or about 20 centimeters), for example, and may have lengths up to about 5 feet (or up to about 1.5 meters) extending vertically into the pre-existing soil, earth, or other material 242 under the base body 104. In some embodiments, the piles 244 and 248 are American National Standards Institute ("ANSI") Schedule 40 micropiles of ASTM International A106 Grade B steel extending about 4 feet (or about 1.2 meters) below the top surface of the compacted sand or gravel 230.

A flexible cable 252 has a loop 254 at one end and a free end shown generally at 256 and opposite the end having the loop 254. The flexible cable 252 may be positioned through the pile 248 with the loop 254 completely through the pile 248, and with the free end 256 freely extending above the base body 104. The flexible cable 252 is a galvanized or stainless steel cable having a diameter of about 0.625 inches (or about 1.6 centimeters) and a breaking strength of about 46,000 pounds (or about 205,000 newtons) or about 50,000 pounds (or about 222,500 newtons) or more. The cables in other embodiments may vary, for example for higher loads that may be required in other embodiments. In the embodiment shown, the loop 254 remains through but near a bottom end of the pile 248. However, in other embodiments, the flexible cable 252 may, after extending through the pile 248, extend upward from the bottom end of the pile 248 and outside of the pile 248 such that the loop 254 is exposed above the top surface 146 of the base body 104, which may facilitate inspecting the position of the loop 254.

Once the flexible cable 252 is positioned through the pile 248, concrete 257 (for example foundation concrete or F-2 concrete with a compressive force of at least about 30 megapascals or at least about 4,350 pounds per square inch) may be poured into the hole 238 and into the through-opening 128 to fill a space surrounding the pile 244 in the hole 238 and in the through-opening 128, and concrete 258 (which may be the same material as the concrete 257) may be poured into the hole 240 and into the through-opening 130 to fill a space surrounding the pile 248 in the hole 240 and in the through-opening 130.

Piles such as those described herein may include cuts or welds to enhance their attachment to the surrounding concrete. Additionally or alternatively, piles such as those described herein may include holes that receive rebar or other material extending generally diametrically across the piles and generally radially outward from the piles. Such rebar or other material may be held in place with nuts, bolts, or other structure and may also enhance attachment of the piles to the surrounding concrete.

Piles such as those described herein may provide flexural strength to the structures in the holes 238 and 240. Further, the concrete 257 and 258 engages with material surrounding the piles 244 and 248 respectively, including the sand or gravel 230 and the pre-existing soil, earth, or other material 242 under the base body 104, and resists shear movement, uplift, compression, and dynamic forces. The piles 244 and 248 thus engage the pre-existing soil, earth, or other material 242 under the base body 104. Further, concrete 258 engages the loop 254 or other portions of the flexible cable 252 to attach the flexible cable 252 to the concrete 258. The concrete 257 and 258 is poured up to the top surface 146 of the base body 104, so the concrete 257 attaches the pile 244 to the base body 104 and the concrete 258 attaches the pile 248 to the base body 104.

Figure 8:
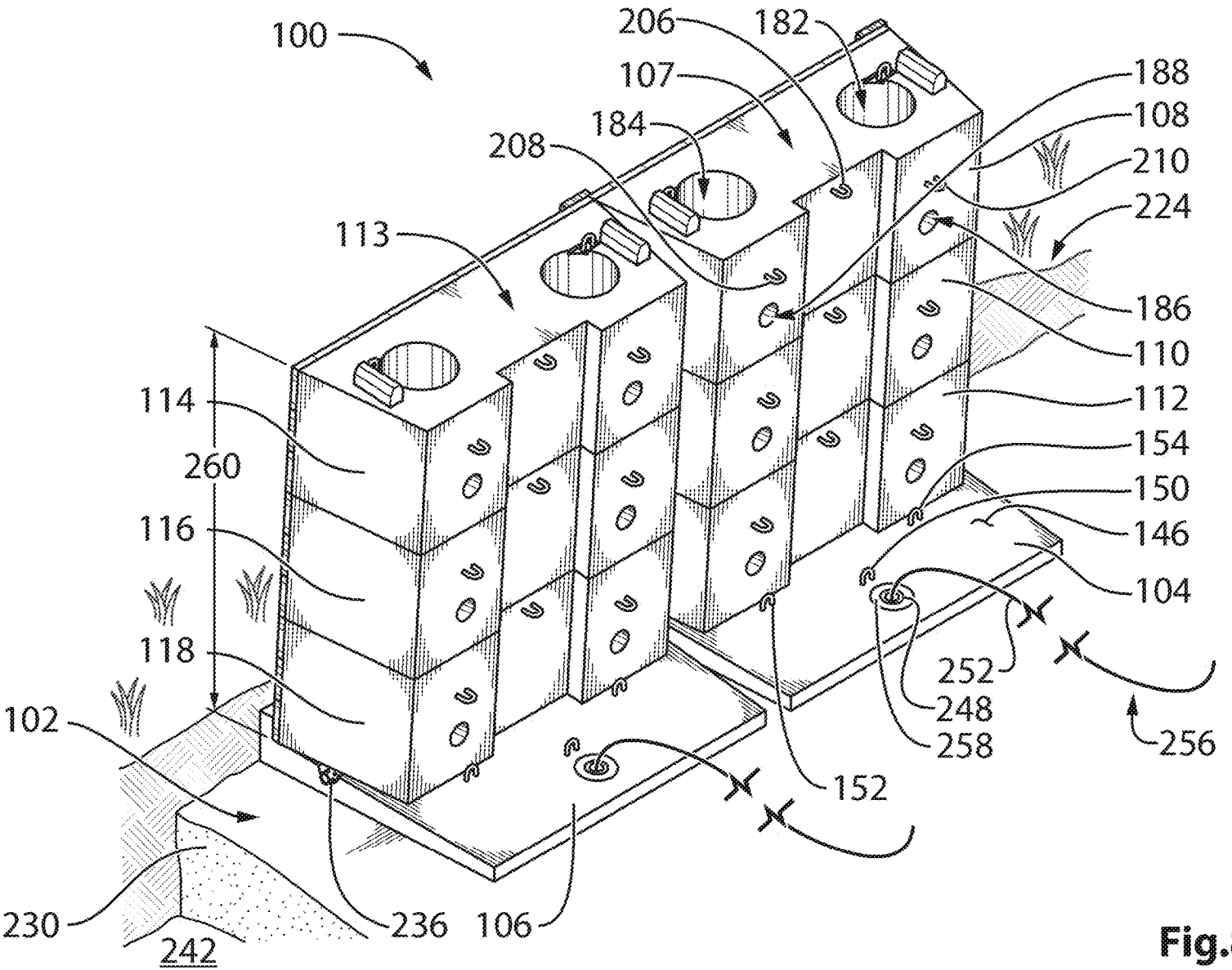
FIG. 8 is a top rear perspective view of the system of FIG. 1, further illustrating the method according to one embodiment of constructing the system of FIG. 1.

Referring to FIGS. 1 and 8, wall blocks may be stacked on the base 102 with the wall blocks 108, 110, and 112 in the stack 107 on the base body 104, and with the wall blocks 114, 116 and 118 in the stack 113 on the base body 106. In the embodiment shown in FIG. 1, in the bottom wall blocks 112 and 118, a bottom portion of the portions on the front side having the images depicting the generally vertical wood board (corresponding to the generally vertical wood board 174) may be removed to allow front surfaces of the bottom wall blocks 112 and 118 to abut retaining projections such as the retaining projection 140. In other embodiments, such bottom portions may remain; in such embodiments, such bottom portions cause a gap between the front surfaces of the bottom wall blocks and the retaining projections of the base bodies, and such a gap may be filled with gravel.

As indicated above, each of the wall blocks 108, 110, 112, 114, 116, and 118 has a height (illustrated as the height 212 in FIG. 3) of about 35.375 inches (or about 89.9 centimeters), and the retaining projections of the base bodies (such as the retaining projection 140 of the base body 104) have a height of about 6 inches (or about 15 centimeters) above the support surfaces of the base bodies (such as the support surface 146 of the base body 104). Therefore, the system 100 has an overall height 260 of about 100.125 inches (or about 254 centimeters) about the retaining projections (such as the retaining projection 140 of the base body 104).

Figure 9:
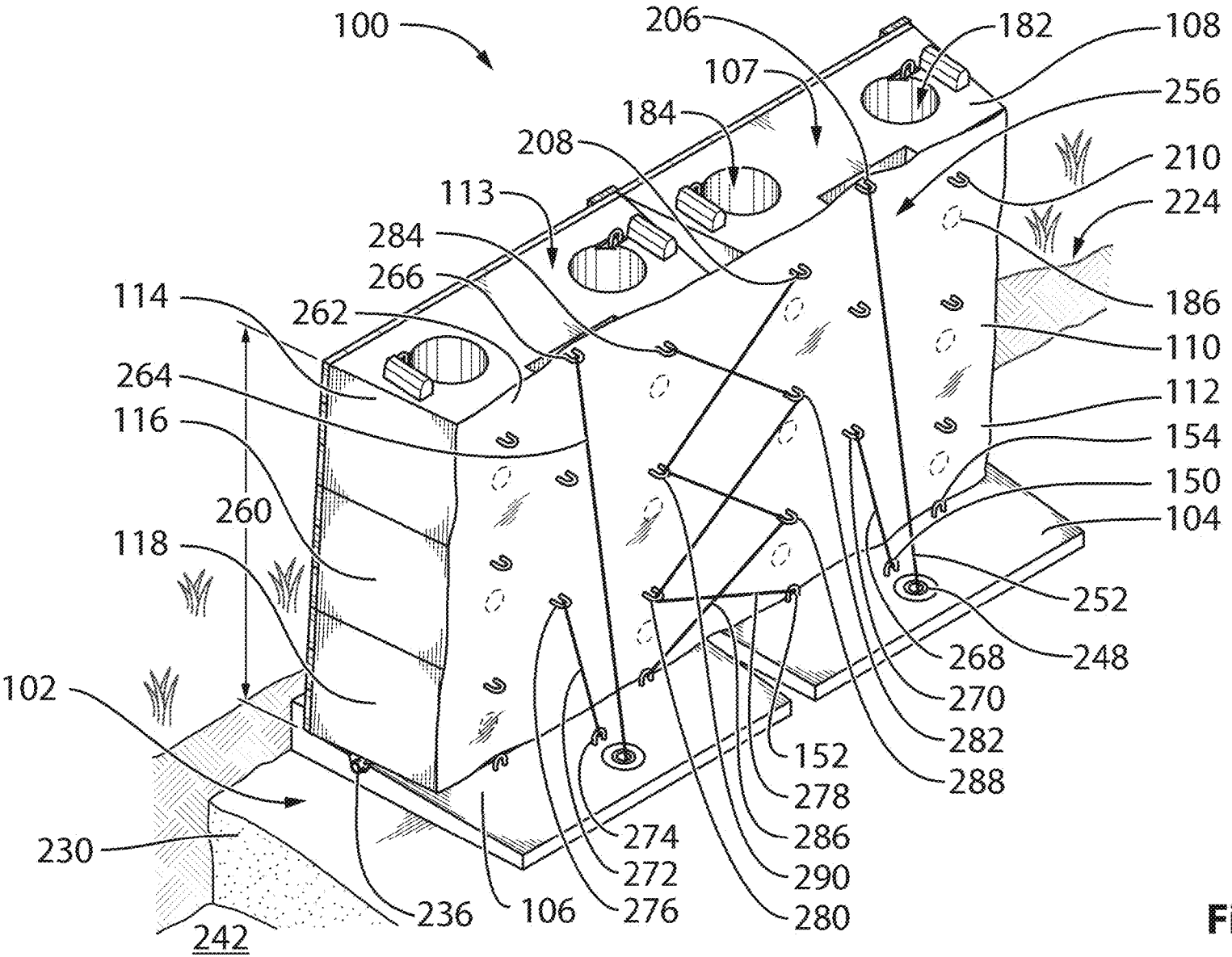
FIG. 9 is another top rear perspective view of the system of FIG. 1, further illustrating the method according to one embodiment of constructing the system of FIG. 1.

Referring to FIG. 9, a filter cloth or drain cloth 262 may be positioned on rear sides (such as the rear side 162 shown in FIGS. 3 and 4) of the wall blocks 108, 110, 112, 114, 116, and 118, and the rear attachment loops (such as the rear attachment loops 206, 208, and 210) of the wall blocks 108, 110, 112, 114, and 116 may protrude through respective openings cut in the filter cloth or drain cloth 262.

As shown in FIG. 9, the wall block 108 may be attached, at the rear side 162 and externally to the wall block 108, to the base body 104 by attaching the free end 256 of the flexible cable 252 to the central rear attachment loop 206, for example by applying tension using a come-a-long winch and fastening the free end 256 of the flexible cable 252 to the central rear attachment loop 206 after such tension is applied. The flexible cable 252 is attached to the base body 104 at a portion of the base body 104 that extends rearward from the rear side 162 of the wall block 108, so the flexible cable 252 attaches the wall block 108 at the rear side 162 to a portion of the base body 104 that extends rearward from the rear side 162 of the wall block 108, and the flexible cable 252 also extends rearward from the rear side 162 of the wall block 108. Likewise, a flexible cable 264 may be attached to the base body 106 and to a central rear attachment loop 266 (corresponding to the central rear attachment loop 206 of the wall block 108) on the wall block 114 to attach the wall block 114, at the rear side, to the base body 106.

Still further, a flexible cable 268 may be attached to the central attachment loop 150 on the base body 104 and to a central rear attachment loop 270 (corresponding to the central rear attachment loop 206 on the wall block 108) on the wall block 112 to attach the wall block 112, at the rear side and externally to the wall block 112, to the base body 104, and a flexible cable 272 may be attached to a central attachment loop 274 (corresponding to the central attachment loop 150 of the base body 104) on the base body 106 and to a central rear attachment loop 276 (corresponding to the central rear attachment loop 206 on the wall block 108) on the wall block 118 to attach the wall block 118, at the rear side, to the base body 106. The central attachment loops 150 and 274 are on respective portions of the base bodies 104 and 106 that extend rearward from the rear side of the wall blocks 112 and 118, so the flexible cables 268 and 272 also attach the wall blocks 112 and 118, at the rear sides, to respective portions of the base bodies 104 and 106 that extend rearward from the rear side of the wall blocks 112 and 118, and the flexible cables 268 and 272 also extend rearward from the rear side of the wall blocks 112 and 118.

Still further, the wall blocks 108, 110, 112, 114, 116, and 118 may be attached, externally and at the rear side, to the base bodies 104 and 106 by lacing adjacent lateral attachment loops of the base bodies 104 and 106 and of the wall blocks 108, 110, 112, 114, 116, and 118. For example, a flexible cable 278 may be attached to the lateral attachment loop 152 on the base body 104 and passed through a lateral rear attachment loop 280 (corresponding to the lateral rear attachment loop 210 on the wall block 108) on the wall block 118 (the lowest wall block in the stack 113), through a lateral rear attachment loop 282 (corresponding to the lateral rear attachment loop 208 on the wall block 108) on the wall block 110 (in the stack 107 and in a row above the wall block 118), and attached to a lateral rear attachment loop 284 (corresponding to the lateral rear attachment loop 210 on the wall block 108) on the wall block 114 (in the stack 113 and in a row above the wall block 110).

Further, a flexible cable 286 may be attached to a lateral attachment loop (corresponding to the lateral attachment loop 154) on the base body 106 and passed through a lateral rear attachment loop 288 (corresponding to the lateral rear attachment loop 208 on the wall block 108) on the wall block 112 (the lowest wall block in the stack 107), through a lateral rear attachment loop 290 (corresponding to the lateral rear attachment loop 210 on the wall block 108) on the wall block 116 (in the stack 113 and in a row above the wall block 112), and attached to the lateral rear attachment loop 208 on the wall block 108 (in the stack 107 and in a row above the wall block 116).

In other words, each of the flexible cables 278 and 286 attaches: the rear side of at least one of wall blocks in a first stack of the plurality of wall blocks; the rear side of at least one of wall blocks in a second stack of the plurality of wall blocks adjacent the first stack; and a ground-stabilizing base body supporting the wall blocks in one of the first and second stacks. Further, the at least one of the wall blocks in the first stack and the at least one of the wall blocks in the second stack are in alternating rows of the first and second stacks, and the flexible cable extends diagonally from the rear side of the at least one of the wall blocks in the first stack to the rear side of the at least one of the wall blocks in the second stack. As the flexible cables 278 and 286 are tensioned, the flexible cables slide against respective attachment surfaces on the attachment loops 280, 282, 288, and 290. The flexible cables 278 and 286 may increase the resistance of the system 100 to earthquake forces, for example.

Like the flexible cable 252, the flexible cables 264, 268, and 272 may be formed from galvanized or stainless steel cables having a diameter of about 0.625 inches (or about 1.6 centimeters) with breaking strengths of about 46,000 pounds (or about 205,000 newtons) or about 50,000 pounds (or about 222,500 newtons) or more. Further, tension on the flexible cables 252, 264, 268, and 272 may be about 300 pounds (or about 1,335 newtons) or more, about 1,000 pounds (or about 4,450 newtons), about 4,000 pounds (or about 17,800 newtons), or about 5,000 pounds (or about 22,250 newtons) or more depending on factors including the overall height 260 and soil conditions surrounding the system 100.

Figure 10:
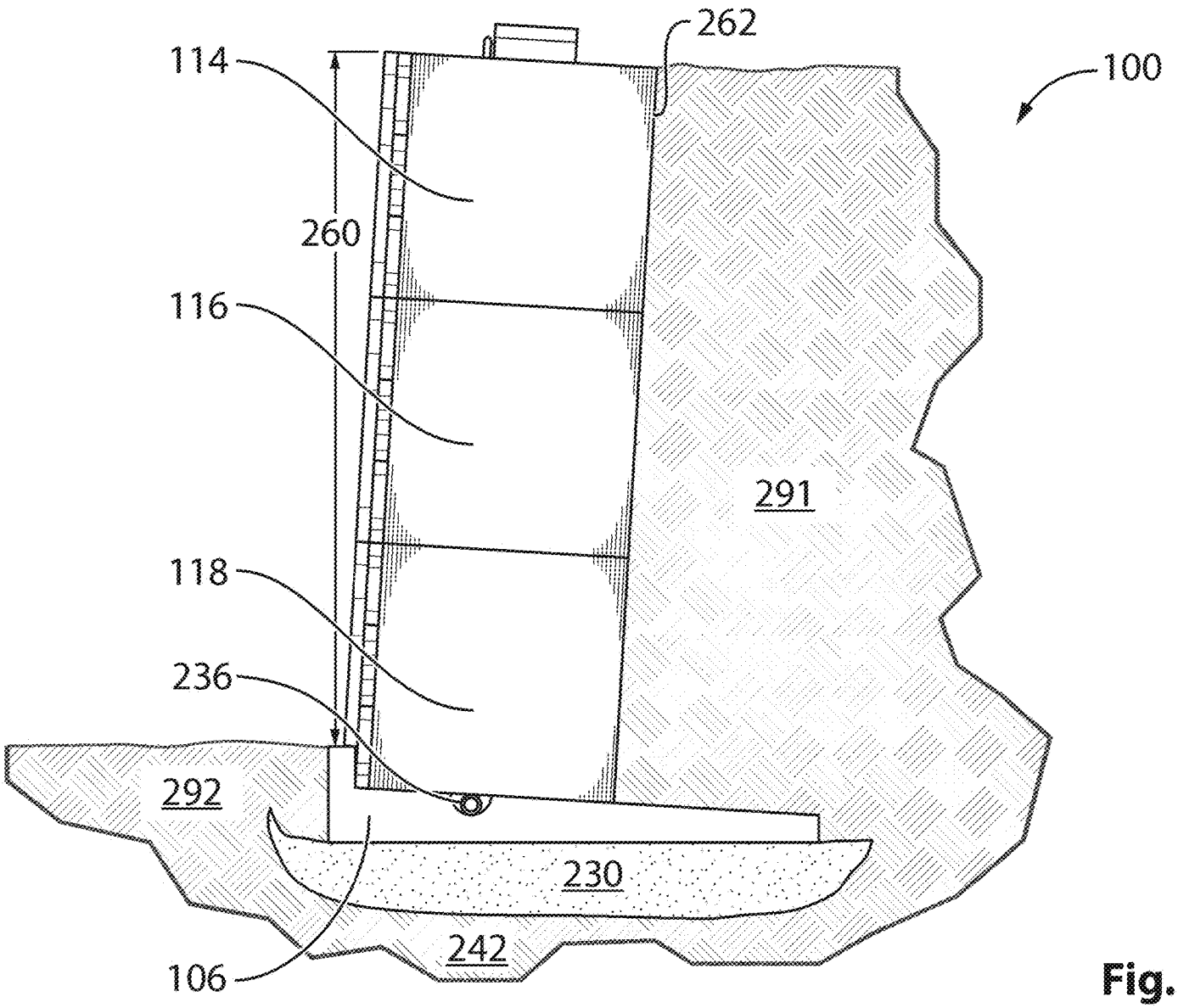
FIG. 10 is a side elevational view of the system of FIG. 1, constructed according to the method according to one embodiment.

Referring to FIGS. 9 and 10, once the system 100 is constructed as described above, the material 291 is positioned against the filter cloth or drain cloth 262, and generally cylindrical drainage inlets (such as the generally cylindrical drainage inlets 186 and 188 on wall block 108 as shown in FIG. 4) of the blocks 108, 110, 112, 114, 116, and 118 receive liquid from the material 291 through the filter cloth or drain cloth 262. As indicated above, the generally cylindrical drainage channels (such as the generally cylindrical drainage channels 182 and 184 on the wall block 108) of the wall blocks 108, 110, 112, 114, 116, and 118 form continuous drainage channels in each stack of wall blocks and throughout the entire height of each stack of wall blocks. The continuous drainage channels in each stack of wall blocks may be filled with material (such as fracture-faced gravel, 0.75-inch or 19-millimeter clear crushed gravel, or other gravel, for example) and may receive liquid from the generally cylindrical drainage inlets (such as the generally cylindrical drainage inlets 186 and 188 on the wall bock 108 as shown in FIG. 4). The bottom of each continuous drainage channel is above one of the base bodies, so the wall blocks are configured to direct liquid from the rear side of the plurality of wall blocks to the base bodies.

The continuous drainage channels in the stacks of wall blocks are positioned above the perforated pipe 236, so that liquid received in the continuous drainage channels can drain into the perforated pipe 236 and out of the system 100 at one or both ends of the perforated pipe 236, for example to a storm drain or another disposal system that may be appropriate.

As shown in FIG. 10, material 291 (such as native granular soil, or "3-inch minus" or "75-millimeter minus" gravel, compacted to 95% SPMDD, for example) may be positioned against the filter cloth or drain cloth 262 and retained against the rear side of the wall blocks 108, 110, 112, 114, 116, and 118. The system 100 thus functions as a retaining wall to retain the material 291. The material 291 is positioned above portions of the base bodies that extend behind the rear side of the wall blocks, and the weight of the material 291 on such portions of the base bodies may help to prevent overturning of the system 100. As indicated above, the flexible cables 252 and 264 attach the wall blocks 108 and 114 to the portions of the base bodies that extend behind the rear side of the wall blocks, so the weight of the material 291 on such portions may hold the wall blocks 108 and 114 in place. Further, holding the wall blocks 108 and 114 in place may more generally hold the stacks 107 and 113 in place because the wall blocks 108 and 114 are coupled to other wall blocks in the stacks 107 and 113.

On a front side of the system 100, additional material 292 may be positioned to restore a natural grade at a level generally parallel to the top edge of the retaining projections (such as the retaining projection 140 shown in FIGS. 1, 2, and 5-7) of the base bodies 104 and 106.

Alternative embodiments may include different numbers of base bodies and different numbers of wall blocks in different numbers of stacks. For example, referring to FIG. 11, a retaining wall system according to another embodiment is shown generally at 293 and includes a stack of wall blocks shown generally at 294 and supported by a base body 295, a stack of wall blocks shown generally at 296 adjacent the stack 294 and supported by a base body 297, and a stack of wall blocks shown generally at 298 adjacent the stack 296 and supported by a base body 299. The wall blocks in the stacks 294, 296, and 298 are substantially the same as the wall block 108, and the base bodies 295, 297, and 299 are substantially the same as the base body 104. The stacks 294, 296, and 298 each include seven wall blocks each having a height (substantially the same as the height 212 shown in FIG. 3) of about 35.375 inches (or about 89.9 centimeters). Retaining projections (corresponding to the retaining projection 140 shown in FIGS. 1, 2, and 5-7) of the base bodies 295, 297, and 299 have heights of about 6 inches (or about 15.3 centimeters) above surfaces of the base bodies 295, 297, and 299 supporting the wall blocks. Therefore, the system 293 has an overall height 300 of over 20 feet, more particularly about 241.625 inches (or about 614 centimeters) above top edges of the retaining projections of the base bodies 295, 297, and 299.

The system 293 may be constructed according to a method similar to the method described above with reference to FIGS. 5-10. For example, a filter cloth or drain cloth may be positioned against rear surfaces of the wall blocks, although a filter cloth or drain cloth is not shown in FIG. 11 for simplicity of illustration. Further, the flexible cables and tensions described below with reference to FIG. 11 may be the same materials and tensions as described above with reference to FIG. 9.

Wall blocks in a second (counting from the bottom) row shown generally at 301 of the seven rows of the wall blocks in the system 293 include: a wall block 302 having a central rear attachment loop 304 (corresponding to the central rear attachment loop 206 shown in FIG. 4) attached to a flexible cable 306 attached to a central attachment loop 308 (corresponding to the central attachment loop 150 shown in FIG. 5) of the base body 299; a wall block 310 having a central rear attachment loop 312 (corresponding to the central rear attachment loop 206 shown in FIG. 4) attached to a flexible cable 314 attached to a central attachment loop 316 (corresponding to the central attachment loop 150 shown in FIG. 5) of the base body 297; and a wall block 318 having a central rear attachment loop 320 (corresponding to the central rear attachment loop 206 shown in FIG. 4) attached to a flexible cable 322 attached to a central attachment loop 324 (corresponding to the central attachment loop 150 shown in FIG. 5) of the base body 295.

Further, wall blocks in a sixth (counting from the bottom) row shown generally at 324 of the seven rows of the wall blocks in the system 293 includes: a wall block 326 having a central rear attachment loop 328 (corresponding to the central rear attachment loop 206 shown in FIG. 4) attached to a free end 330 of a flexible cable 332 (corresponding to the flexible cable 252 shown in FIGS. 7-9) attached to the base body 299 and to a pile of the base body 299; a wall block 334 having a central rear attachment loop 336 (corresponding to the central rear attachment loop 206 shown in FIG. 4) attached to a free end 338 of a flexible cable 340 (corresponding to the flexible cable 252 shown in FIGS. 7-9) attached to the base body 297 and to a pile of the base body 297; and a wall block 342 having a central rear attachment loop 344 (corresponding to the central rear attachment loop 206 shown in FIG. 4) attached to a free end 346 of a flexible cable 348 (corresponding to the flexible cable 252 shown in FIGS. 7-9) attached to the base body 295 and to a pile of the base body 295.

Figure 11:
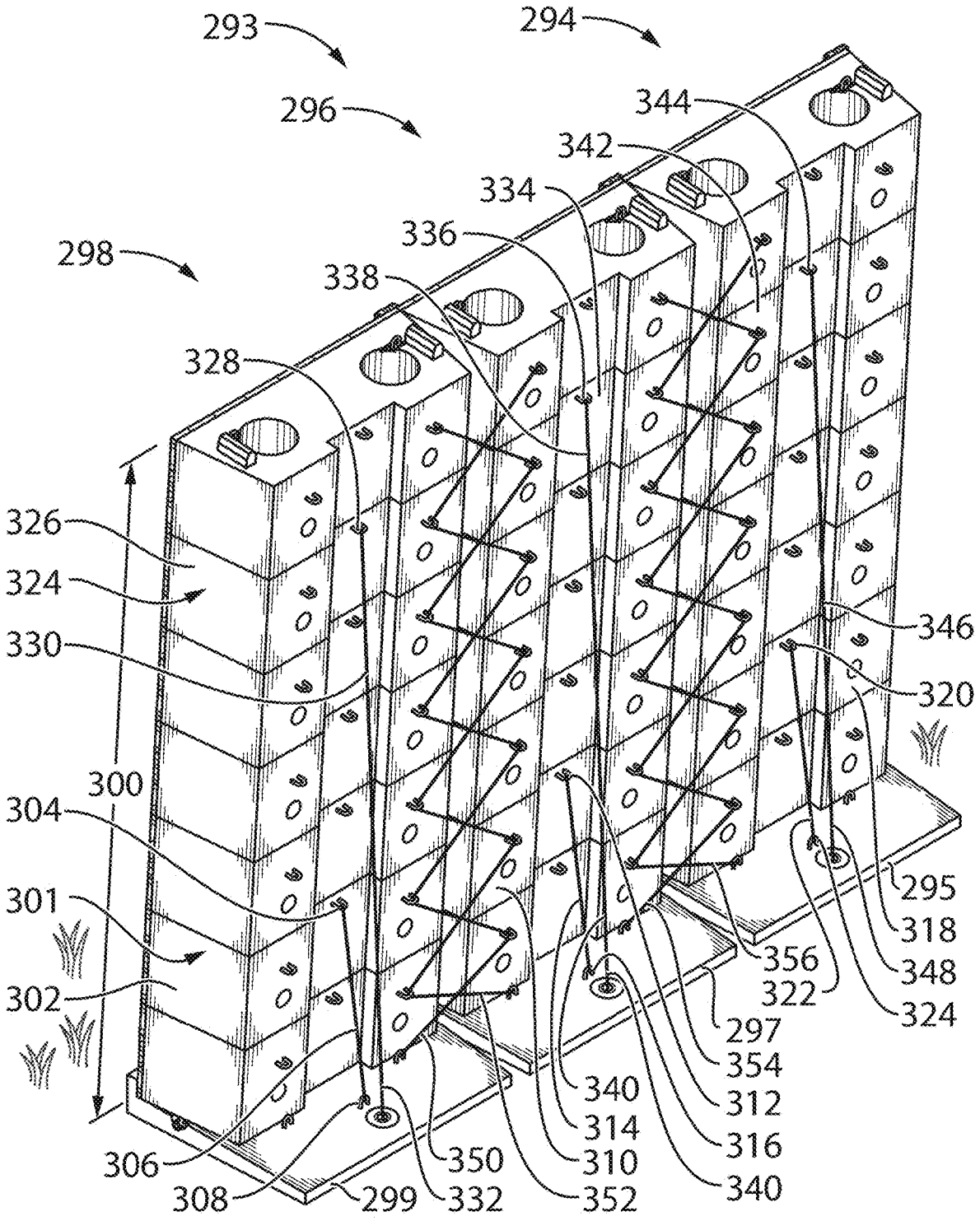
FIG. 11 is a top rear perspective view of a retaining wall system according to another embodiment.

In the embodiment of FIG. 11, the second and sixth (counting from the bottom) rows 301 and 324 were chosen based on the overall height 300 and particular lateral soil load, drainage conditions, earthquake loading, and other external surcharge loading conditions. In other embodiments, retaining wall systems may have different overall heights, and the rows that are attached to the base bodies may differ according to factors such as the overall height, lateral soil load, drainage conditions, earthquake loading, and other external surcharge loading conditions.

Further, adjacent lateral rear attachment loops of the wall blocks in adjacent columns of the system 293 may be attached using flexible cables 350, 352, 354, and 356 as shown in FIG. 11. As shown in FIG. 11, each of the flexible cables 350, 352, 354, and 356 attaches: the rear side of at least one of wall blocks in a first stack of the plurality of wall blocks; the rear side of at least one of wall blocks in a second stack of the plurality of wall blocks adjacent the first stack; and a ground-stabilizing base body supporting the wall blocks in one of the first and second stacks. Further, the at least one of the wall blocks in the first stack and the at least one of the wall blocks in the second stack are in alternating rows of the first and second stacks, and the flexible cable extends diagonally from the rear side of the at least one of the wall blocks in the first stack to the rear side of the at least one of the wall blocks in the second stack.

In embodiments such as those described herein, base bodies are connected to piles, which extend into and engage material under the base bodies. By extending into and engaging material under the base bodies, the piles (and thus the base bodies including and attached to the piles) may stabilize the material under the base bodies, may increase the bearing capacity of the material under the base bodies, and may prevent movement of the base bodies laterally, vertically, and rotationally relative to the material under the base bodies. Base bodies in embodiments such as those described herein are thus ground-stabilizing base bodies.

Further, attaching wall blocks to the base bodies in embodiments such as those described herein may support the wall blocks relative to the base bodies and relative to the piles, which may also prevent movement of the wall blocks laterally, vertically, and rotationally relative to the material under the base bodies independently of geogrid, independently of reinforced earth, and independently of any structure in the material retained against the rear side of the wall blocks.

Therefore, embodiments such as those described herein may be supported against lateral pushout, overturning, global failure, static forces, and earthquake forces, for example, and may be so supported with significantly less excavation of backfill regions than would be required retaining walls using reinforced earth such as geogrid, for example. Further, backfill material in embodiments such as those described herein may be readily available native earth or other inexpensive materials, rather than more-expensive materials that may be required for constructing reinforced earth, so embodiments such as those described herein may not only allow for less excavation when compared to retaining walls using reinforced earth, but may also avoid costs of discarding of excavated material and acquiring replacement material for constructing reinforced earth.

Although specific embodiments have been described and illustrated, such embodiments should be considered illustrative only and not as limiting the invention as construed according to the accompanying claims.

What is claimed is:

1. A method of stabilizing a retaining wall comprising a plurality of wall blocks positioned to retain material against a rear side of the plurality of wall blocks, the plurality of wall blocks comprising a first stack of the plurality of wall blocks and a second stack of the plurality of wall blocks on a lateral side of the first stack of the plurality of wall blocks, the method comprising attaching at least one of the plurality of wall blocks in the first stack of the plurality of wall blocks, on the rear side of the at least one of the plurality of wall blocks, to at least one ground-stabilizing base body positioned under and supporting the second stack of the plurality of wall blocks and not positioned under the first stack of the plurality of the plurality of wall blocks.

2. The method of claim 1 wherein attaching the at least one of the plurality of wall blocks to the at least one ground-stabilizing base body comprises applying tension to at least one flexible cable attached to the rear side of the at least one of the plurality of wall blocks and to the at least one ground-stabilizing base body.

3. The method of claim 2 wherein applying tension to the at least one flexible cable comprises applying tension to a flexible cable attached to the rear side of one of the plurality of wall blocks and to a portion of the at least one ground-stabilizing base body extending rearward from the rear side of the at least one of the plurality of wall blocks.

4. The method of claim 2 wherein:

the at least one flexible cable comprises a flexible cable attached to the rear side of the at least one of the wall blocks in the first stack of the plurality of wall blocks, to the rear side of at least one of the wall blocks in the second stack of the plurality of wall blocks, and to the at least one ground-stabilizing base body; and applying tension to the at least one flexible cable comprises applying tension to the flexible cable attached to the rear side of the at least one of the wall blocks in the first stack of the plurality of wall blocks, to the rear side of the at least one of the wall blocks in the second stack of the plurality of wall blocks, and to the at least one ground-stabilizing base body.

5. The method of claim 4 wherein:

the at least one of the wall blocks in the first stack and the at least one of the wall blocks in the second stack are in vertically different rows of the first and second stacks; and the at least one flexible cable extends diagonally from the rear side of the at least one of the wall blocks in the first stack to the rear side of the at least one of the wall blocks in the second stack.

6. The method of claim 4 wherein applying tension to the flexible cable comprises:

sliding the flexible cable against a first attachment surface on the rear side of the at least one wall block in the first stack; and sliding the flexible cable against a second attachment surface on the rear side of the at least one wall block in the second stack.

7. The method of claim 1 further comprising engaging at least one pile attached to the at least one ground-stabilizing base body with material under the at least one ground-stabilizing base body.

8. The method of claim 7 wherein engaging the at least one pile with the material under the at least one ground-stabilizing base body comprises positioning concrete in at least one respective space between the at least one pile and the material under the at least one ground-stabilizing base body.

9. The method of claim 1 further comprising, when the at least one ground-stabilizing base body is already formed and before supporting the plurality of wall blocks on the at least one ground-stabilizing base body, positioning the at least one ground-stabilizing base body into a position on a surface for supporting the plurality of wall blocks.

10. The method of claim 1 wherein:

the plurality of wall blocks define at least one drainage channel in the retaining wall and configured to direct liquid, received in the retaining wall from the rear side of the plurality of wall blocks, to the at least one ground-stabilizing base body; and the at least one ground-stabilizing base body defines at least one drainage channel configured to direct liquid, from the at least one drainage channel of the plurality of wall blocks, out of the retaining wall.

11. The method of claim 1 wherein:

the at least one flexible cable comprises a flexible cable attached to at least one of the plurality of wall blocks in the second stack of the plurality of wall blocks, on the rear side of the at least one of the plurality of wall blocks, and attached to the at least one ground-stabilizing base body; and applying tension to the at least one flexible cable comprises applying tension to the flexible cable attached to the at least one of the plurality of wall blocks in the second stack of the plurality of wall blocks and attached to the at least one ground-stabilizing base body.

12. A method of stabilizing a retaining wall comprising a plurality of wall blocks positioned to retain material against a rear side of the plurality of wall blocks, the method comprising applying tension to a flexible cable attached to at least one of the plurality of wall blocks, on the rear side of the at least one of the plurality of wall blocks, wherein the flexible cable is attached to a pile attached to a portion of at least one ground-stabilizing base body positioned under and supporting the plurality of the plurality of wall blocks, the portion of the at least one ground-stabilizing base body extending rearward from the rear side of the at least one of the plurality of wall blocks, the pile engaging material under the at least one ground-stabilizing base body.

13. The method of claim 12 wherein:

the plurality of wall blocks comprises a stack of the plurality of wall blocks;

the stack of the plurality of wall blocks comprises the at least one of the plurality of wall blocks; and the at least one ground-stabilizing base body is positioned under and supports the stack of the plurality of wall blocks.

14. A retaining wall system comprising:

a plurality of wall blocks retaining material on a rear side of the plurality of wall blocks, the plurality of wall blocks comprising a first stack of the plurality of wall blocks and a second stack of the plurality of wall blocks on a lateral side of the first stack of the plurality of wall blocks; and at least one ground-stabilizing base body positioned under and supporting the second stack of the plurality of the plurality of wall blocks and not positioned under the first stack of the plurality of the plurality of wall blocks;

wherein at least one of the plurality of wall blocks in the first stack of the plurality of wall blocks is attached, on the rear side of the at least one of the plurality of wall blocks, to the at least one ground-stabilizing base body.

15. The system of claim 14 further comprising at least one flexible cable attaching the rear side of the at least one of the plurality of wall blocks and the at least one ground-stabilizing base body.

16. The system of claim 15 wherein:

the at least one ground-stabilizing base body comprises a portion extending rearward from the rear side of the at least one of the plurality of wall blocks; and the at least one flexible cable comprises a flexible cable attached to rear side of one of the plurality of wall blocks and to the portion of the at least one ground-stabilizing base body extending rearward from the rear side of the at least one of the plurality of wall blocks.

17. The system of claim 15 wherein: the at least one flexible cable comprises a flexible cable attaching the rear side of the at least one of the wall blocks in the first stack, the rear side of at least one of the wall blocks in the second stack, and the at least one ground-stabilizing base body.

18. The system of claim 17 wherein:

the at least one of the wall blocks in the first stack and the at least one of the wall blocks in the second stack are in vertically different rows of the first and second stacks; and the flexible cable extends diagonally from the rear side of the at least one of the wall blocks in the first stack to the rear side of the at least one of the wall blocks in the second stack.

19. The system of claim 14 wherein:

the plurality of wall blocks define at least one drainage channel in the retaining wall and configured to direct liquid, received in the retaining wall from the rear side of the plurality of wall blocks, to the at least one ground-stabilizing base body; and the at least one ground-stabilizing base body defines at least one drainage channel configured to direct liquid, from the at least one drainage channel of the plurality of wall blocks, out of the system.

20. A retaining wall system comprising:

a plurality of wall blocks retaining material on a rear side of the plurality of wall blocks;

at least one ground-stabilizing base body positioned under and supporting the plurality of the plurality of wall blocks, the at least one ground-stabilizing base body comprising a portion extending rearward from the rear side of the at least one of the plurality of wall blocks;

a pile attached to the portion of the at least one ground-stabilizing base body and engaging material under the at least one ground-stabilizing base body; and a flexible cable attached to at least one of the plurality of wall blocks, on the rear side of the at least one of the plurality of wall blocks, and attached to the pile.

21. The system of claim 20 wherein:

the plurality of wall blocks comprises a stack of the plurality of wall blocks;

the stack of the plurality of wall blocks comprises the at least one of the plurality of wall blocks; and the at least one ground-stabilizing base body is positioned under and supports the stack of the plurality of wall blocks.

* * * * *